US006505948B2

(12) United States Patent
Cekic et al.

(10) Patent No.: US 6,505,948 B2
(45) Date of Patent: Jan. 14, 2003

(54) METHOD OF MODIFYING THE SPECTRAL DISTRIBUTION OF HIGH-INTENSITY ULTRAVIOLET LAMPS

(75) Inventors: Miodrag Cekic, Bethesda, MD (US); Mark W. Ruckman, Montgomery Village, MD (US)

(73) Assignee: Fusion UV Systems, Inc., Gaithersburg, MD (US)

( * ) Notice: Subject to any disclaimer, the term of this patent is extended or adjusted under 35 U.S.C. 154(b) by 50 days.

(21) Appl. No.: 09/818,630

(22) Filed: Mar. 28, 2001

(65) Prior Publication Data

US 2002/0141176 A1 Oct. 3, 2002

(51) Int. Cl.[7] ..... F21V 9/16; H01J 65/04

(52) U.S. Cl. ..... 362/84; 362/293; 250/504 R; 315/39; 315/344

(58) Field of Search ..... 315/39, 111.21, 315/111.51, 246, 248, 267, 344; 313/231.31, 231.61, 483, 493; 250/504 R; 362/84, 260, 296, 293

(56) References Cited

U.S. PATENT DOCUMENTS

| | | | | |
|---|---|---|---|---|
| 3,054,013 A | | 9/1962 | Johnson | 313/108 |
| 3,525,864 A | | 8/1970 | Leach | 250/71 |
| 3,872,349 A | | 3/1975 | Spero et al. | 315/39 |
| 4,189,661 A | * | 2/1980 | Haugsjaa et al. | 315/39 |
| 4,230,698 A | | 10/1980 | Vedrine et al. | 252/301.4 |
| 4,859,097 A | | 8/1989 | Minematu et al. | 313/487 |
| 4,990,789 A | * | 2/1991 | Uesaki | 250/504 R |
| 5,193,097 A | | 3/1993 | Bordui et al. | 372/21 |
| 5,290,730 A | | 3/1994 | McFarlane et al. | 437/129 |
| 5,379,311 A | | 1/1995 | McFarlane et al. | 372/41 |
| 5,502,626 A | | 3/1996 | Armstrong et al. | 362/216 |
| 5,517,516 A | | 5/1996 | Marshall et al. | 372/41 |
| 5,754,572 A | | 5/1998 | Pinto et al. | 372/20 |
| 5,852,623 A | | 12/1998 | Castillo et al. | 372/41 |
| 5,990,624 A | * | 11/1999 | Maya | 315/39 |

FOREIGN PATENT DOCUMENTS

| | | | | |
|---|---|---|---|---|
| JP | 5442383 | | 4/1979 | |
| JP | 5512143 | | 1/1980 | |
| JP | 401264103 A | * | 10/1989 | 362/227 |
| JP | 0999106 | | 4/1997 | |
| JP | 10260349 | | 9/1998 | |
| JP | 216459 | | 1/1999 | |

* cited by examiner

*Primary Examiner*—Alan Cariaso
(74) *Attorney, Agent, or Firm*—Antonelli, Terry, Stout & Kraus, LLP

(57) ABSTRACT

The invention is a microwave excited light source. A microwave excited light source in accordance with the invention includes a microwave source (100) which produces microwaves; a microwave excited light bulb (106), coupled to the microwave source, which produces an output spectrum 108 and operates within a first temperature range when producing the output spectrum with at least one frequency range of the output spectrum having a power level below a desired level; and an optical component (20, 40, 60, 70, 110, 116 and 118), spaced from the light bulb which operates in a second temperature range below the first temperature range, having at least one phosphor (112) which is excited by another frequency range of the output spectrum, the at least one phosphor in response to the another frequency range outputs light in the at least one portion which increases the power level to the desired level.

57 Claims, 6 Drawing Sheets

METHOD OF MODIFYING THE SPECTRAL DISTRIBUTION OF HIGH-INTENSITY ULTRAVIOLET LAMPS

BACKGROUND OF THE INVENTION

1. Field of the Invention

The present invention relates to microwave excited light sources which utilize a phosphor(s) or phosphor containing component(s) coated on or within components external to a microwave excited light bulb therein to produce a desired light output spectrum augmented by the light output spectrum produced by the phosphor(s) or phosphor containing component(s).

2. Description of the Prior Art

The Assignee of the present invention sells microwave excited light sources using light bulbs having a medium to high filling pressure and high applied microwave power which produce high radiance in the UV frequency range. Bulbs of a one to ten-inch nominal length are powered with a range of microwave power from 1 kW to 10 kW. These UV light sources have nominal power loads ranging from 100 watts/inch to 1000 watts/inch. The Assignee's microwave excited UV light sources convert the input electrical power to a UV light output with an efficiency of between 10–35%. Microwave excited UV light sources have the advantage of producing high output power and a frequency stable spectrum from more than 3,000 hours of operation.

FIG. 1 illustrates a prior art UV spectrum produced by the Assignee's microwave excited UV light sources. As is apparent in the UV range, there is a substantial drop off in output power between 300–350 nm. The spectrum illustrated in FIG. 1 is provided upon request to customers of the Assignee's microwave-powered electrodeless lamps to enable the customers to best understand the frequency ranges present in the UV light output used for the customers' UV light applications.

The aging of surfaces, coatings, etc., with irradiation from between 290–420 nm, is conventionally performed to determine the properties of the surface coatings in response to extended exposure to solar radiation. The higher the irradiance of the UV light, the more rapid an aging study may be completed. The spectrum of a commercial solar lamp has rising UV power emission in the spectral range between 300–350 nm. The prior art spectrum illustrated in FIG. 1 has a total maximum emission at about 330 nm. The Assignee's microwave excited UV light sources can produce a much higher power irradiance than a commercial solar lamp and more efficiently convert the input power into light than a commercial solar lamp. However, the UV spectral distribution of the Assignee's microwave excited UV light sources is not most suitable to perform solar aging studies in view of the large drop off in the potentially important wavelength range between 300–350 nm.

A need exists for a high efficiency, high power solar irradiation light source which simulates the UV light spectrum produced by the sun as well or better than standard solar lamps so as to permit accelerated solarization studies of a wide variety of surfaces, paints, coatings, etc.

In a fluorescent lamp, a phosphor placed on an inner wall of the lamp downshifts the UV emission of a low-pressure mercury discharge into the optical range. More than one phosphor or a phosphor with more than one activator may be used to produce a desired color.

Phosphors that fluoresce in low power lamps in the ultraviolet range between 295–400 nm produce UV-A, B or C emissions are used for tanning and medical treatment.

Phosphors containing thallium, lead or europium activators in a variety of host materials produce emissions which lie in the range between 300–350 nm. However, such materials are temperature sensitive and their light conversion efficiency decreases with temperature. The aforementioned properties restrict incorporation of these phosphor materials into a bulb wall with a temperature below 100° C.

SUMMARY OF THE INVENTION

The present invention is a high efficiency, high intensity microwave driven light source having a preferred application as a UV light source. A light source in accordance with the invention utilizes high power microwave excitation to produce UV light with wavelengths which excite a phosphor (s) or phosphor(s) containing components or compositions coated on or within optical components external to the microwave excited light bulb. The phosphor(s) or phosphor (s) containing components or compositions produce light emissions in a desired frequency range(s) of the output spectrum which is additive to the power level of the output spectrum in the desired frequency range(s) produced by the microwave excited lamp bulb to achieve a desired power output in the desired frequency range(s) of or in the entire output spectrum. The downshifting provided by UV phosphor(s) or UV phosphor(s) containing components or compositions on surfaces of or within components of a microwave-powered UV light source external to the light bulb, whether on reflective surfaces, filters, windows, optics, or a pellicle, separates temperature sensitive phosphor(s) or phosphor(s) containing components or compositions from the high temperature of the microwave excited bulb so that the microwave powered light source can be operated at high power output with any desired light spectrum at whatever temperature is required for optimal operation. High intensity light produced by microwave excited light bulbs prevents phosphors from being coated thereon in view of their high output surface temperatures which may exceed 1,000° C.

With the invention the spectral distribution of light produced by microwave-powered light sources, which are optimized for other purposes such as the efficiency of producing light from the input electrical power, permits operation without having to introduce additional chemical components or compounds, as dopants into the bulb fill.

As used herein, a phosphor(s) includes a phosphor(s) alone or as part of components or compositions containing a phosphor(s) which phosphoresce to produce light in the visible or UV range. The phosphors may be a surface coating on or within the optical components external to the light bulb.

A microwave excited light source in accordance with the invention includes a microwave source which produces microwaves; a microwave excited lamp bulb, coupled to the microwave source, which produces an output spectrum and operates within a first temperature range when producing an output spectrum with at least one frequency range of the output spectrum having a power level below a desired level; and an optical component, spaced from the bulb which operates in a second temperature range below the first temperature range, having at least one phosphor which is excited by another frequency range of the output spectrum, the at least one phosphor in response to the another frequency range outputs light in the at least one frequency range which increases the power level to the desired level. The optical component may be a filter through which the output spectrum passes. The optical component may be a reflector which reflects the output spectrum. The optical component may be a window through which the output spectrum passes. The at least one phosphor may be operational within the second temperature range and may be rendered non-operational at the first temperature range. The one and the another frequency range of the spectrum may be in the UV range.

The invention is a microwave excited UV light source including a microwave excited UV lamp bulb, coupled to the microwave source, which produces an UV output spectrum representative of UV light produced by the sun and having an operation temperature range when producing the UV output spectrum with at least one frequency range of the UV output spectrum in a first UV wavelength range having a power level below a desired level; an optical component, spaced from the bulb, which operates in a second temperature range below the first temperature range having at least one phosphor which is excited by at least one frequency range of the UV output spectrum within a second UV wavelength range shorter than the first UV wavelength range, the at least one phosphor in response to the at least one frequency range within the second UV wavelength range outputting UV light within the at least one frequency range of the first UV wavelength range which increases the power level to the desired level; and the at least one phosphor is operational within the second temperature range and is rendered non-operational at the first temperature range. The second UV wavelength range may have a maximum wavelength of approximately 300 nm; and the first UV wavelength range may be between approximately 300–450 nm and preferable, the first wavelength range may be between approximately 300–350 nm. The second wavelength range may be approximately centered about 250 nm. The at least one phosphor may be $Ca_3(PO_4)_2$:Tl or $(Ca_{0.9}Zn_{0.1})_3(PO_4)_2$:Tl and have 3–4 mol % Tl. The at least one phosphor may be $Sr_2MgSi_2O_7$:Pb, $BaSi_2O_5$:Pb, $Ba_{1.6}Sr_{0.4}Si_2O_5$:Pb, $Ba_2ZnSi_2O_7$:Pb, or $SrB_4O_7F$:Eu. The optical component may be a reflector which reflects the UV output spectrum, a filter through which the UV output spectrum passes, or a window through which the UV output spectrum passes.

BRIEF DESCRIPTION OF THE DRAWINGS

Like reference numerals identify like parts throughout the drawings.

DESCRIPTION OF THE PREFERRED EMBODIMENTS

Figure 2:
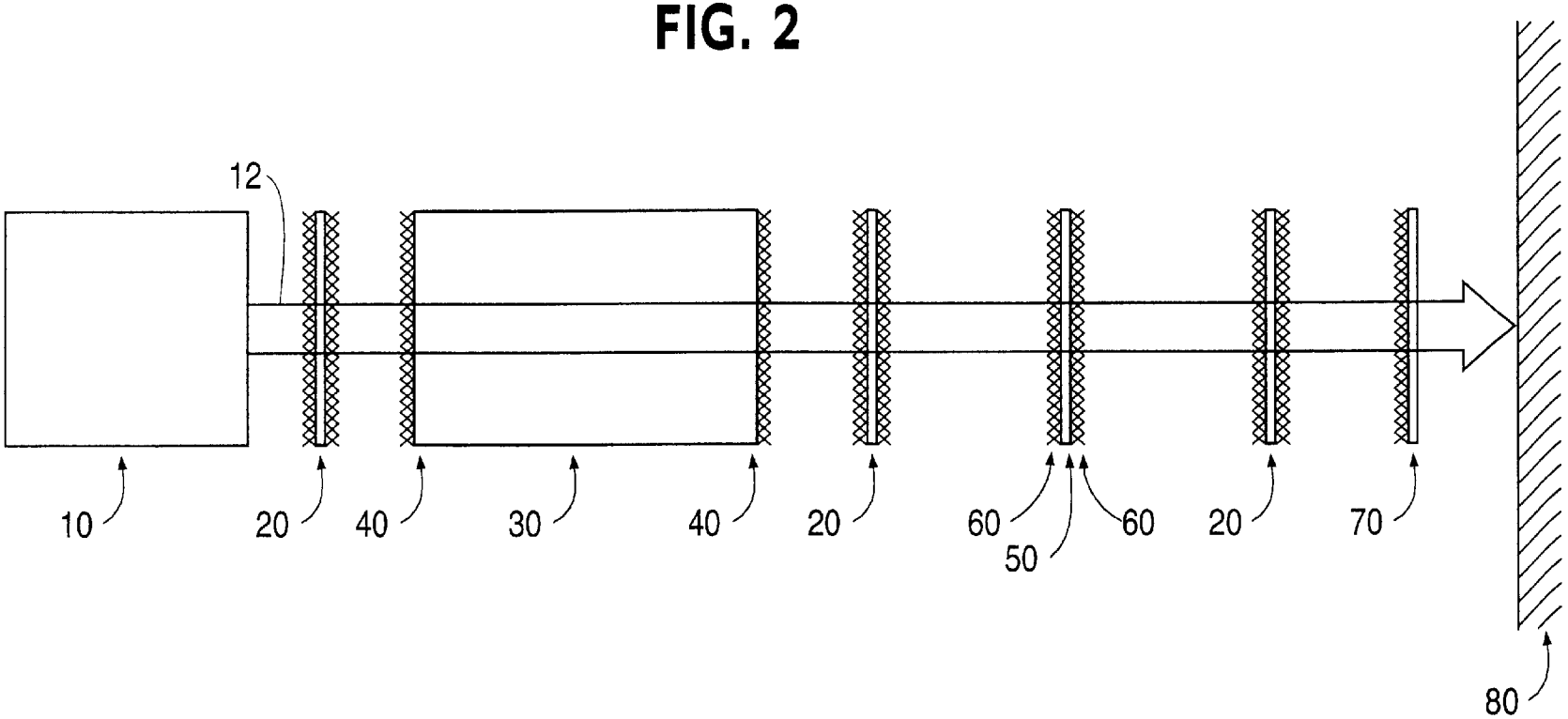
FIG. 2 illustrates a schematic of an embodiment of a microwave excited light source in accordance with the invention.

FIG. 2 illustrates an embodiment of the present invention. A microwave excited high intensity light source 10 produces a high power light spectrum which is enhanced externally beyond the light source to boost the power of frequency components produced by a microwave excited light bulb contained in the light source. The invention has a preferred application of producing a UV spectrum with a most preferred application being for the simulation of the UV spectrum of natural sunlight for providing expedited aging studies of surfaces, coatings, paints, films, etc. Microwave excited light source 10 is of conventional construction which is preferably a UV light source. The high intensity light source 10 includes a microwave source (not illustrated) which produces microwaves; a microwave excited light bulb (not illustrated) to which the microwaves are coupled by a microwave cavity (not illustrated) in a conventional manner. The output light spectrum 12 is produced by emissions from the light bulb which operates within a first temperature range. At least one frequency range of the output light spectrum 12 has the radiance below a desired level. An optical component, spaced from the bulb, operates in a second temperature range, below the first temperature range, which has at least one phosphor which is excited by at least one other frequency range of the output light spectrum produced by the light bulb. The at least one phosphor in response to the at least one other frequency range of the output spectrum emits light in the at least one frequency range having a power level below the desired level which increases the power level to the desired level. The light 12 contains the higher energy in at least one other frequency range which is in the UV range and is used to excite the at least one phosphor on or within one or more surfaces of diverse components in the microwave excited light source through which the light 12 passes as explained below.

The phosphors may be coated surfaces on or contained in the various components exterior to the microwave excited bulb. One or more components external from the light bulb contains or is coated with a thin film or surface coating containing at least one phosphor on at least one face which is excited by higher energy UV to produce lower energy visible or UV light in the desired spectrum in which a higher power level is desired. While the phosphor(s) are illustrated as a surface coating in the form of "xxx", it should be understood that the illustration is representative of the phosphor(s) within the materials from which the optical components external to the light bulb are made. At least one filter 20 may be provided in the path of the light 12 which contains or is coated with a thin film or surface coating of the at least one phosphor on one or both sides as illustrated, which is excited by the higher energy excitation UV spectrum to produce the lower energy emission spectrum which may be either in the visible or UV range. Additionally, optics 30 may contain or be coated on at least one, and preferably on two faces, with a thin film or surface coating 40 containing the at least one phosphor which is excited by the higher energy frequency range of the output light spectrum containing at least one phosphor to emit light in a desired lower frequency range to enhance the output light spectrum in a frequency range where enhancement is desirable. Additionally, a window 50 containing the phosphor(s) or having a thin film or surface coating 60 containing the at least one phosphor, may be placed in the light 12. Finally, a pellicel 70 containing the phosphor(s) or coated with a thin film or a surface coating containing the at least one phosphor, may be placed in the output light 12. A target 80 is illuminated by light to which has been added additional light power in at least one lower energy frequency range of the output spectrum which is not present at a sufficient power level in the output light 12 produced from the microwave excited light source 10. The resultant overall spectrum reaching the target 80, which is preferably in the UV range, has the desired power level across the desired light spectrum. The target 80 may be a surface, a surface coating, paint or a film, etc., which is to be illuminated with the light of the desired power level in the desired optical spectrum such as, but not limited to, UV light, which simulates natural sunlight to perform expedited aging studies of the target which approximate the effect of natural sunlight.

As illustrated, phosphors or phosphor containing components or compositions are within or are coated on any one or more of the surfaces of filters 20, the optics 30, the window 50 and the pellicel 70 to enhance the output spectrum to the desired power level.

Figure 3:
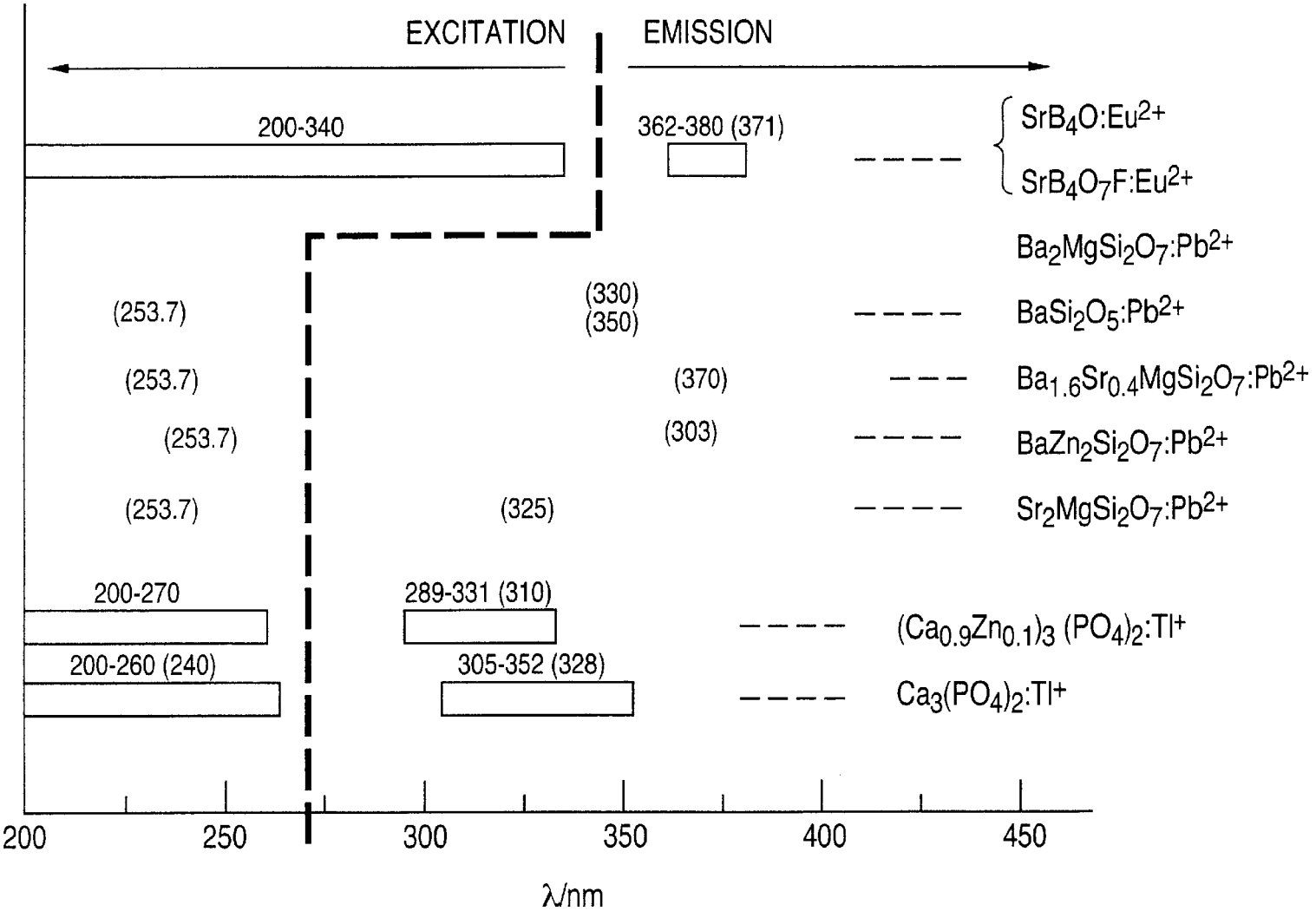
FIG. 3 illustrates the emission spectrum of various phosphors or phosphor containing components or compositions which may be used with the microwave excited lamp source of the invention.

FIG. 3 illustrates phosphors or phosphor containing materials or compositions which may be used in the embodiment of FIG. 2 and the embodiments of the invention described below in conjunction with FIGS. 4, 6 and 7. The excitation frequency range for each phosphor is at a shorter wavelength than the emission frequency range which produces the increased power level in the one or more frequency ranges of the output spectrum produced by the microwave excited bulb which has a power level below a desired level.

Figure 1:
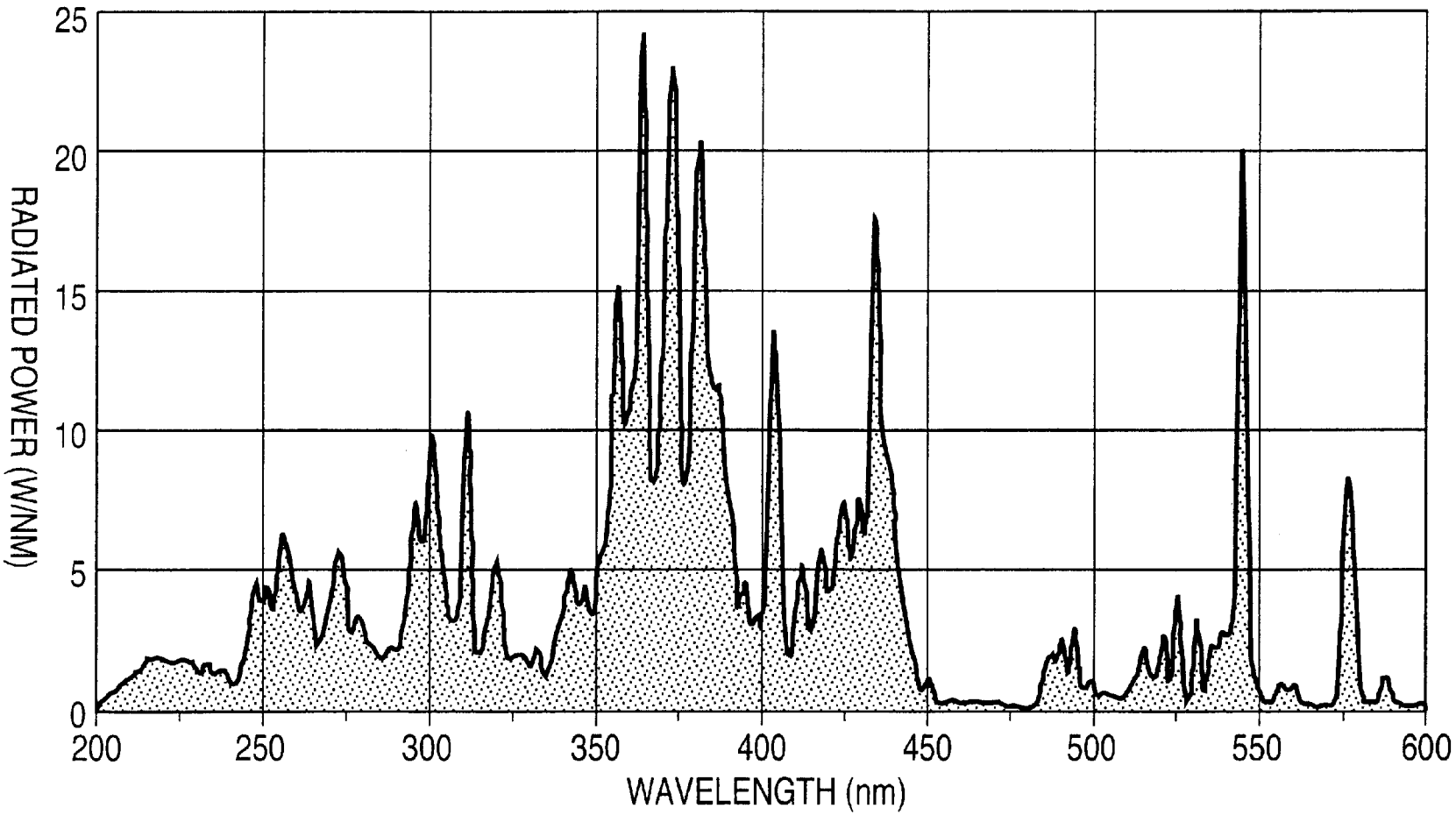
FIG. 1 (PRIOR ART)
FIG. 1 illustrates the prior art light output spectrum of a microwave excited UV light source sold by the Assignee of the present invention.

For some of the phosphors, a range of excitation frequencies is represented by a pair of numbers separated by a dash. For other phosphors, a very narrow frequency range excitation in parenthesis, such as 253.7 nm produced by mercury emission, is used as the excitation frequency to produce a narrow peak emission output frequency range also in parenthesis. Each of the phosphors in FIG. 3 is thermally stable when placed within the optical compounds or coated on the surfaces of the optical components of the microwave powered light source of the invention which are external to the light bulb surface and produces emissions which enhance the UV spectrum of FIG. 1.

Each phosphor may be excited with high intensity short wave UV light to produce the enhanced power output in the range between approximately 300–380 nm required to increase the light output power present in the Assignee's commercial microwave-powered UV lamps to permit expedited solar aging studies to be performed. Each phosphor of FIG. 3 may be within or coated directly on exterior surfaces external to the light bulb surface as described above which are illuminated by the light emitted from the microwave powered light source.

Figure 4:
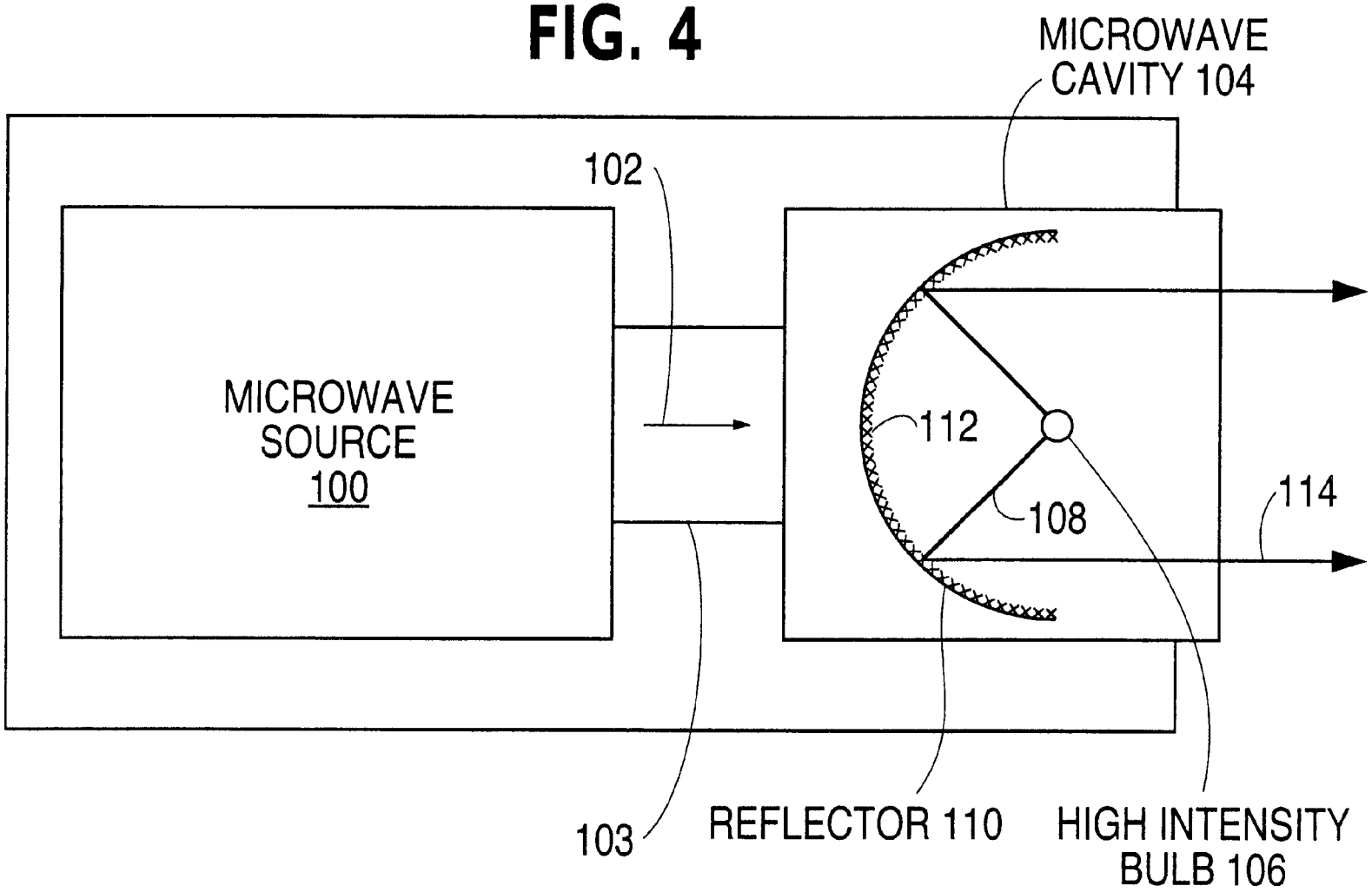
FIG. 4 illustrates another embodiment of the present invention.

FIG. 4 illustrates a second embodiment of the present invention utilizing a conventional microwave source 100 such as that present in the Assignee's microwave powered UV lamps. The microwave source 100 produces microwaves 102 which are transmitted by a waveguide 103 to a microwave cavity 104 in which a high intensity microwave excited bulb 106 is located which may produce either visible or UV light. The output light 108, which has at least one frequency range of the output spectrum of a deficient power level required for the application of the embodiment, is incident on a reflector 110 of conventional design containing or coated with a surface coating or layer 112 containing the at least one phosphor such as, but not limited to, those contained in FIG. 3. The output light 114 has an increased power level in the at least one frequency range of the output spectrum 100 as a result of the emissions produced by the surface coating or layer 112. The power level of the output light 114, as a result of the emissions from the phosphor 112, is at the desired output power level necessary for the application such as enhanced solar aging studies.

Figure 5:
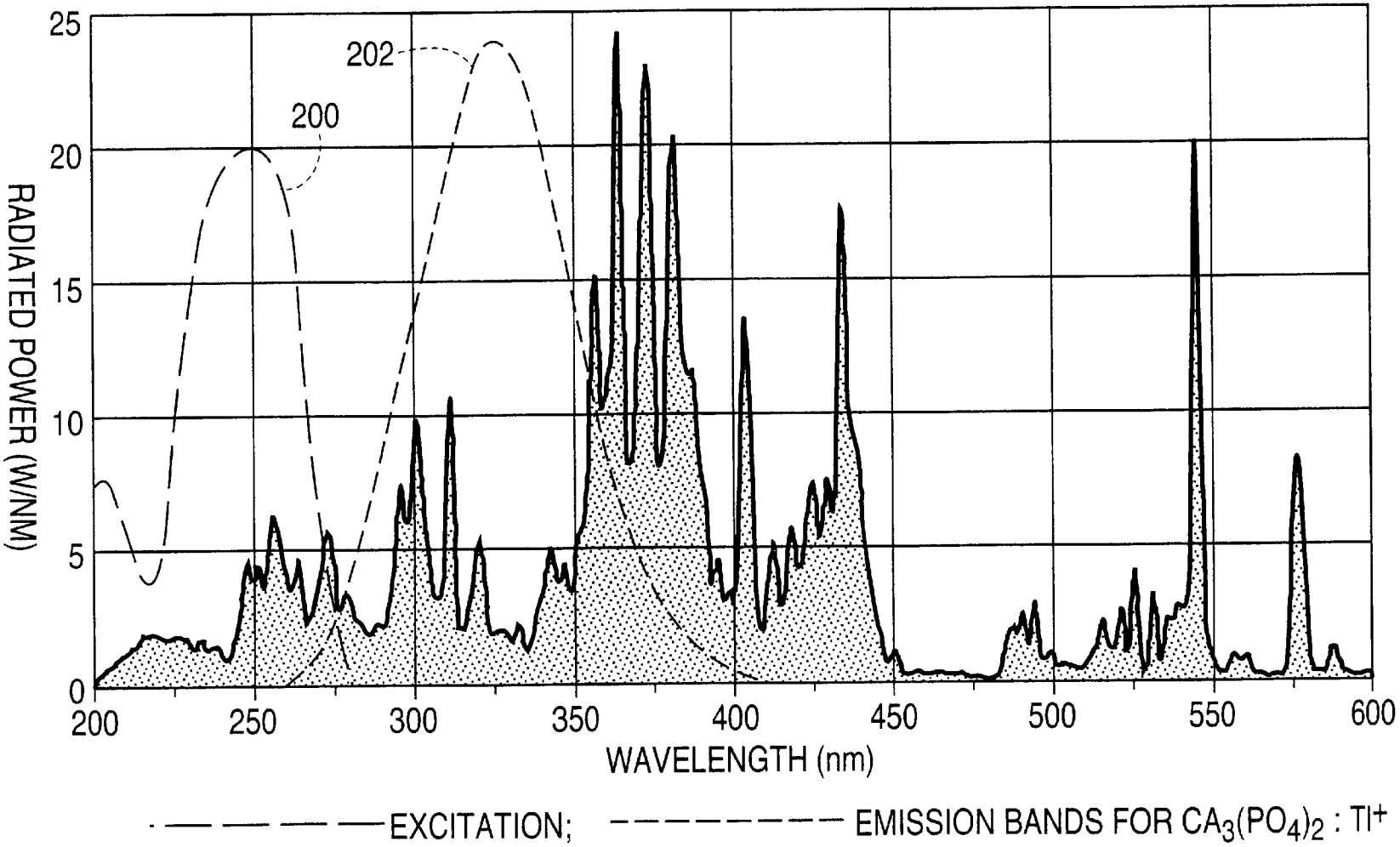
FIG. 5 illustrates the output spectrum of a microwave excited UV light source in accordance with the present invention which has been modified from the standard output spectrum of FIG. 1 to simulate solar radiation.

FIG. 5 illustrates an output light spectrum of the embodiments of the invention in FIGS. 2, 4, 6, and 7 when using $(Ca_{0.9}Zn_{0.1})_3(PO_4)_2$:Tl. As illustrated, the dotted line excitation spectrum 200 produced by $(Ca_{0.9}Zn_{0.1})_3(PO_4)_2$:Tl is centered around 250 nm. The resultant emission spectrum 202 peaks at around 330 nm. The resultant cumulative spectrum, with enhanced irradiance between 300–380 nm, approximates the UV spectrum present in solar light, which is desired to perform enhanced aging studies of surfaces, coatings, paints, etc.

Figure 6:
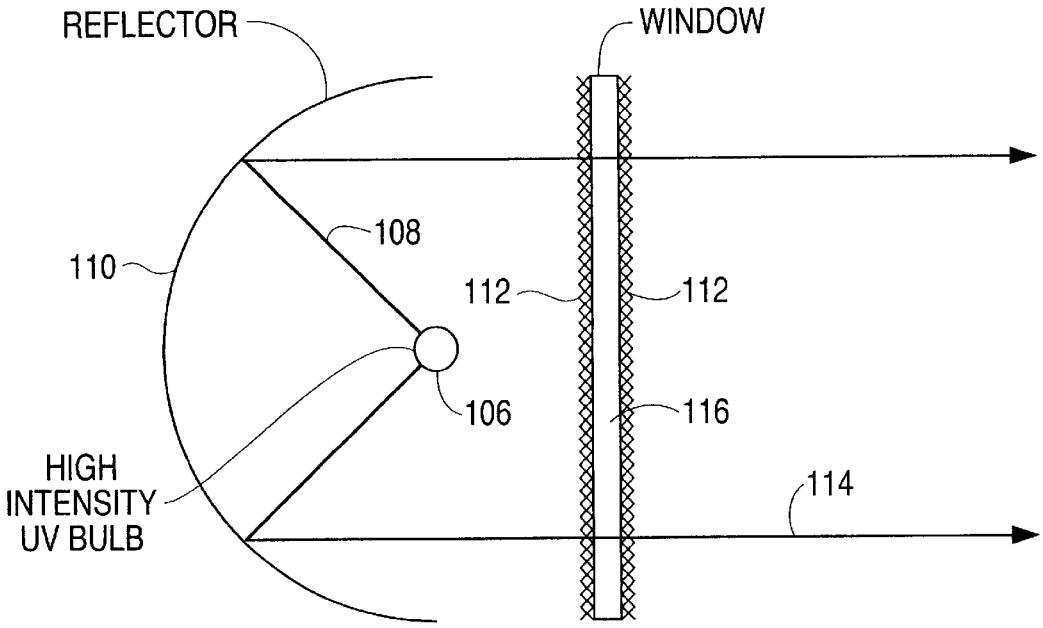
FIG. 6 illustrates another embodiment of the present invention.

FIG. 6 illustrates another embodiment of the invention in which only the reflector 110 is shown containing or including the phosphor 112 coated on both sides of window 116 of the microwave excited light source to produce output light with at least one frequency range of the output spectrum 108 having been increased in power level by the presence of the phosphor contained in the components of or coated on one or more surfaces of the components of the optical system 116.

Figure 7:
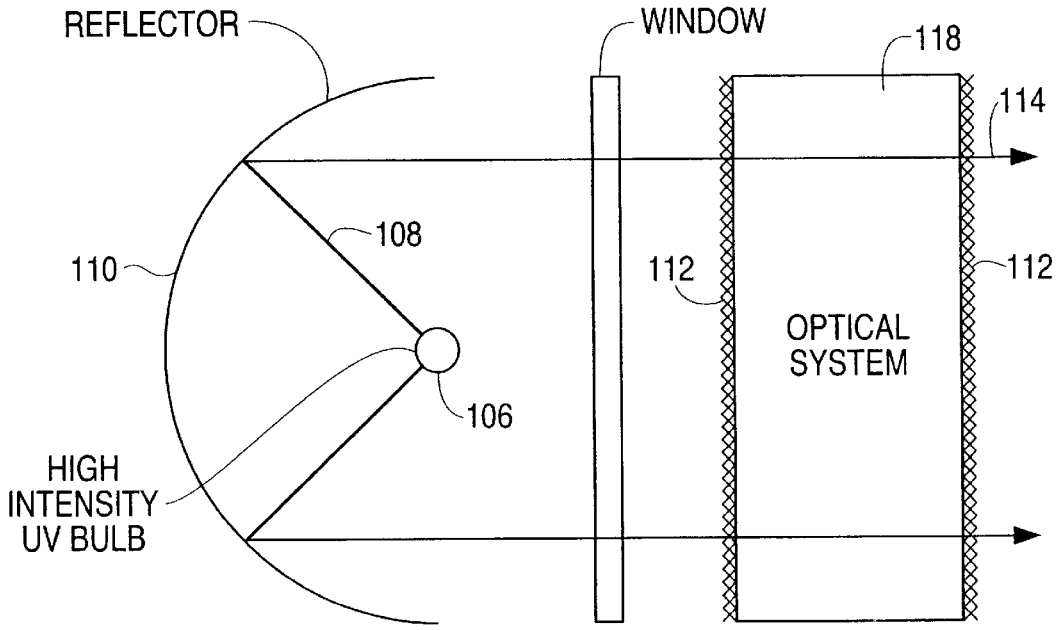
FIG. 7 illustrates yet another embodiment of the present invention.

FIG. 7 illustrates another embodiment of the invention in which the phosphor 112 is coated on the surfaces of the optical system or is within the components of the optical system 118 to produce output light 114 with at least one frequency range of the output spectrum 108 having been increased in power level by the presence of the phosphor 112 within the optical system.

While the invention has been described in terms of its preferred embodiments, it should be understood that numerous modifications may be made thereto without departing from the spirit and scope of the invention. For example, the at least one phosphor, which preferably produces output light in the UV spectrum for performing enhanced aging studies, may be applied to enhance other spectra, such as of the visible output spectrum, to produce high intensity output light having a specifically selected spectrum of a high power level which is not produced by microwave excitation of a bulb alone. It is intended that all such modifications fall within the scope of the appended claims.

What is claimed is:

1. A microwave excited light source comprising:

a microwave source which produces microwaves;

a microwave excited light bulb, coupled to the microwave source, which produces an output spectrum and operates within a first temperature range when producing the output spectrum with at least one frequency range of the output spectrum having a power level below a desired level; and an optical component, spaced from the light bulb which operates in a second temperature range below the first temperature range, having at least one phosphor which is excited by another frequency range of the output spectrum, the at least one phosphor in response to the another frequency range outputs light in the at least one frequency range which increases the power level to the desired level; and wherein the one and the another range of the spectrum are UV.

2. A microwave excited light source in accordance with claim 1 wherein:

the optical component is an optical filter through which the output spectrum passes.

3. A microwave excited light source in accordance with claim 1 wherein:

the optical component is a reflector which reflects the output spectrum.

4. A microwave excited light source in accordance with claim 1 wherein:

the optical component is a window through which the output spectrum passes.

5. A microwave excited light source in accordance with claim 1 wherein:

the at least one phosphor is operational within the second temperature range and rendered non-operational at the first temperature range.

6. A microwave excited light source in accordance with claim 2 wherein:

the at least one phosphor is operational within the second temperature range and rendered non-operational at the first temperature range.

7. A microwave excited light source in accordance with claim 3 wherein:

the at least one phosphor is operational within the second temperature range and rendered non-operational at the first temperature range.

8. A microwave excited light source in accordance with claim 4 wherein:

the at least one phosphor is operational within the second temperature range and rendered non-operational at the first temperature range.

9. A microwave excited UV light source comprising:

a microwave source which produces microwaves;

a microwave excited UV light bulb, coupled to the microwave source, which produces an UV output spectrum representative of UV light produced by the sun and having an operation temperature range when producing the UV output spectrum with at least one frequency range of the UV output spectrum in a first UV wavelength range having a power level below a desired level;

an optical component, spaced from the light bulb, which operates in a second temperature range below the first temperature range having at least one phosphor which is excited by at least one frequency range of the UV output spectrum within a second UV wavelength range shorter than the first UV wavelength range, the at least one phosphor in response to the at least one frequency range within the second UV wavelength range outputting UV light within the at least one frequency range of the first UV wavelength range which increases the power level to the desired level; and the at least one phosphor is operational within the second temperature range and is rendered non-operational at the first temperature range.

10. A microwave excited UV light source in accordance with claim 9 wherein:

the second UV wavelength range has a maximum wavelength of approximately 300 nm; and the first UV wavelength range is between approximately 300–450 nm.

11. A microwave excited UV light source in accordance with claim 10 wherein:

the first UV wavelength range is between approximately 300–350 nm.

12. A microwave excited UV light source in accordance with claim 11 wherein:

the second UV wavelength range is approximately centered about 250 nm.

13. A microwave excited UV light source in accordance with claim 9 wherein:

the at least one phosphor is $Ca_3(PO_4)_2$:Tl.

14. A microwave excited UV light source in accordance with claim 9 wherein:

the at least one phosphor is $(Ca_{0.9}Zn_{0.1})_3(PO_4)_2$:Tl.

15. A microwave excited UV light source in accordance with claim 13 wherein:

the at least one phosphor has 3–4 mol % Tl.

16. A microwave excited UV light source in accordance with claim 14 wherein:

the at least one phosphor has 3–4 mol % Tl.

17. A microwave excited UV light source in accordance with claim 9 wherein:

the at least one phosphor is $Sr_2MgSi_2O_7$:Pb.

18. A microwave excited UV light source in accordance with claim 9 wherein:

the at least one phosphor is $BaSi_2O_5$: Pb.

19. A microwave excited UV light source in accordance with claim 9 wherein:

the at least one phosphor is $(Ba_{1.6}Sr_{0.4})Si_2O_7$:Pb.

20. A microwave excited UV light source in accordance with claim 9 wherein:

the at least one phosphor is $Ba_2ZnSi_2O_7$:Pb.

21. A microwave excited UV light source in accordance with claim 9 wherein:

the at least one phosphor is $SrB_4O_7F$:Eu.

22. A microwave excited UV light source in accordance with claim 9 wherein:

the optical component is a reflector which reflects the UV output spectrum.

23. A microwave excited UV light source in accordance with claim 10 wherein:

the optical component is a reflector which reflects the UV output spectrum.

24. A microwave excited UV light source in accordance with claim 11 wherein:

the optical component is a reflector which reflects the UV output spectrum.

25. A microwave excited UV light source in accordance with claim 12 wherein:

the optical component is a reflector which reflects the UV output spectrum.

26. A microwave excited UV light source in accordance with claim 13 wherein:

the optical component is a reflector which reflects the UV output spectrum.

27. A microwave excited UV light source in accordance with claim 14 wherein:

the optical component is a reflector which reflects the UV output spectrum.

28. A microwave excited UV light source in accordance with claim 15 wherein:

the optical component is a reflector which reflects the UV output spectrum.

29. A microwave excited UV light source in accordance with claim 16 wherein:

the optical component is a reflector which reflects the UV output spectrum.

30. A microwave excited UV light source in accordance with claim 17 wherein:

the optical component is a reflector which reflects the UV output spectrum.

31. A microwave excited UV light source in accordance with claim 18 wherein:

the optical component is a reflector which reflects the UV output spectrum.

32. A microwave excited UV light source in accordance with claim 19 wherein:

the optical component is a reflector which reflects the UV output spectrum.

33. A microwave excited UV light source in accordance with claim 20 wherein:

the optical component is a reflector which reflects the UV output spectrum.

34. A microwave excited UV light source in accordance with claim 9 wherein:

the optical component is an optical filter through which the UV output spectrum passes.

35. A microwave excited UV light source in accordance with claim 10 wherein:

the optical component is an optical filter through which the UV output spectrum passes.

36. A microwave excited UV light source in accordance with claim 11 wherein:

the optical component is an optical filter through which the UV output spectrum passes.

37. A microwave excited UV light source in accordance with claim 12 wherein:

the optical component is an optical filter through which the UV output spectrum passes.

38. A microwave excited UV light source in accordance with claim 13 wherein:

the optical component is an optical filter through which the UV output spectrum passes.

39. A microwave excited UV light source in accordance with claim 14 wherein:

the optical component is an optical filter through which the UV output spectrum passes.

40. A microwave excited UV light source in accordance with claim 15 wherein:

the optical component is an optical filter through which the UV output spectrum passes.

41. A microwave excited UV light source in accordance with claim 16 wherein:

the optical component is an optical filter through which the UV output spectrum passes.

42. A microwave excited UV light source in accordance with claim 17 wherein:

the optical component is an optical filter through which the UV output spectrum passes.

43. A microwave excited UV light source in accordance with claim 18 wherein:

the optical component is an optical filter through which the UV output spectrum passes.

44. A microwave excited UV light source in accordance with claim 19 wherein:

the optical component is an optical filter through which the UV output spectrum passes.

45. A microwave excited UV light source in accordance with claim 20 wherein:

the optical component is an optical filter through which the UV output spectrum passes.

46. A microwave excited UV light source in accordance with claim 9 wherein:

the optical component is a window through which the UV output spectrum passes.

47. A microwave excited UV light source in accordance with claim 10 wherein:

the optical component is a window through which the UV output spectrum passes.

48. A microwave excited UV light source in accordance with claim 11 wherein:

the optical component is a window through which the UV output spectrum passes.

49. A microwave excited UV light source in accordance with claim 12 wherein:

the optical component is a window through which the UV output spectrum passes.

50. A microwave excited UV light source in accordance with claim 13 wherein:

the optical component is a window through which the UV output spectrum passes.

51. A microwave excited UV light source in accordance with claim 14 wherein:

the optical component is a window through which the UV output spectrum passes.

52. A microwave excited UV light source in accordance with claim 15 wherein:

the optical component is a window through which the UV output spectrum passes.

53. A microwave excited UV light source in accordance with claim 16 wherein:

the optical component is a window through which the UV output spectrum passes.

54. A microwave excited UV light source in accordance with claim 17 wherein:

the optical component is a window through which the UV output spectrum passes.

55. A microwave excited UV light source in accordance with claim 18 wherein:

the optical component is a window through which the UV output spectrum passes.

56. A microwave excited UV light source in accordance with claim 19 wherein:

the optical component is a window through which the UV output spectrum passes.

57. A microwave excited UV light source in accordance with claim 20 wherein:

the optical component is a window through which the UV output spectrum passes.

* * * * *